United States Patent [19]

Madison

[11] 3,973,663

[45] Aug. 10, 1976

[54] TYPEWRITER POWER ROLL CONSTRUCTION AND MOUNTING

[75] Inventor: Theodore N. Madison, Windsor, Conn.

[73] Assignee: Litton Business Systems, Inc., New York, N.Y.

[22] Filed: Dec. 13, 1974

[21] Appl. No.: 532,711

Related U.S. Application Data

[62] Division of Ser. No. 333,389, Feb. 16, 1973, Pat. No. 3,876,054.

[52] U.S. Cl. ..... 197/16; 192/26; 197/17

[51] Int. Cl.[2] ..... B41J 23/02

[58] Field of Search ..... 197/16–18, 197/55; 101/348, 349; 24/132 AC, 132 AA, 132 AB, 249 R; 403/240, 196, 197; 192/26, 415, 56

[56] References Cited

UNITED STATES PATENTS

| | | | |
|---|---|---|---|
| 2,861,516 | 11/1958 | Harless | 101/348 |
| 3,232,402 | 2/1966 | Koenen et al. | 197/17 |
| 3,371,764 | 3/1968 | Aden et al. | 197/17 |
| 3,536,172 | 10/1970 | Frechette | 192/26 |
| 3,720,297 | 3/1973 | Frechette | 197/17 |

FOREIGN PATENTS OR APPLICATIONS

| | | | |
|---|---|---|---|
| 799,115 | 11/1968 | Canada | 24/249 PP |

*Primary Examiner*—Ralph T. Rader
*Attorney, Agent, or Firm*—Joseph R. Spalla; Arthur Gershman

[57] ABSTRACT

A typewriter power roll having a hollow core is assembled with end bearings which are adapted to rotatably support the power roll on a stationary center shaft. Assembling the core and end bearings as a unit allows the periphery to be ground concentric with the bearing axes. After grinding, the power roll can be located in a typewriter and the center shaft inserted through side frame openings and the bearings and adjustably secured to the typewriter side frames at opposite ends by being wedged between a slotted surface of an adjusting plate adjustably secured to the side frames and an eccentric mounted on the adjusting plate.

3 Claims, 2 Drawing Figures

TYPEWRITER POWER ROLL CONSTRUCTION AND MOUNTING

BACKGROUND OF THE INVENTION

Figure 1:
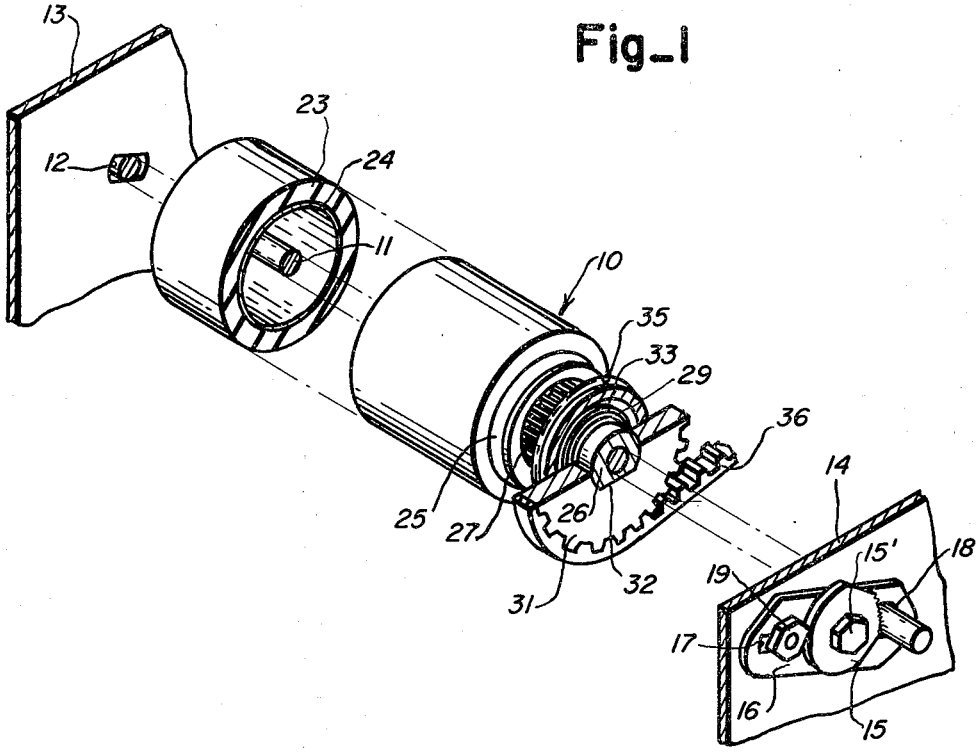

This application is a division of application Ser. No. 333,389, filed Feb. 16, 1973 now U.S. Pat. No. 3,876,054.

This invention relates to power rolls for typewriters or like machines; more particularly, it relates to a power roll assembly which is easily mounted on or removable from a stationary center support shaft extending through bearings secured to the power roll; and specifically, it relates to power rolls with integral bearings supported on a stationary shaft adjustably secured relative to machine side frames.

Known prior art power rolls are assembled as a unit including a center shaft which is supported for rotation in frame mounted bearings. After assembly of such a power roll, the periphery is usually ground to make it concentric with the center shaft.

SUMMARY OF THE INVENTION

In accordance with the invention, a power roll having a hollow core is provided at each end with bearings, one of which includes a power roll drive pulley. The power roll is rotatably supported on a power roll support shaft which is adjustably secured to left and right machine side frames.

An object of the invention is in the provision of a power roll capable of being easily manufactured and assembled and easily mounted on a stationary support shaft removably mounted therein.

Another object of the invention is to provide a power roll which includes bearings at its ends which rotatably support the power roll on a stationary frame supported shaft.

A further object of the invention is to provide a power roll support shaft which is adjustably secured to machine side frames by being wedged between the surface of an adjusting plate adjustably secured to the side frame and an eccentric mounted on the adjusting plate.

Still other objects, features and advantages of the present invention will become apparent to those skilled in the art from a reading of the following detailed description of a preferred embodiment, taken in conjunction with the accompanying drawing wherein like reference numerals designate like or corresponding parts throughout the several views and wherein.

IN THE DRAWING

Figure 2:
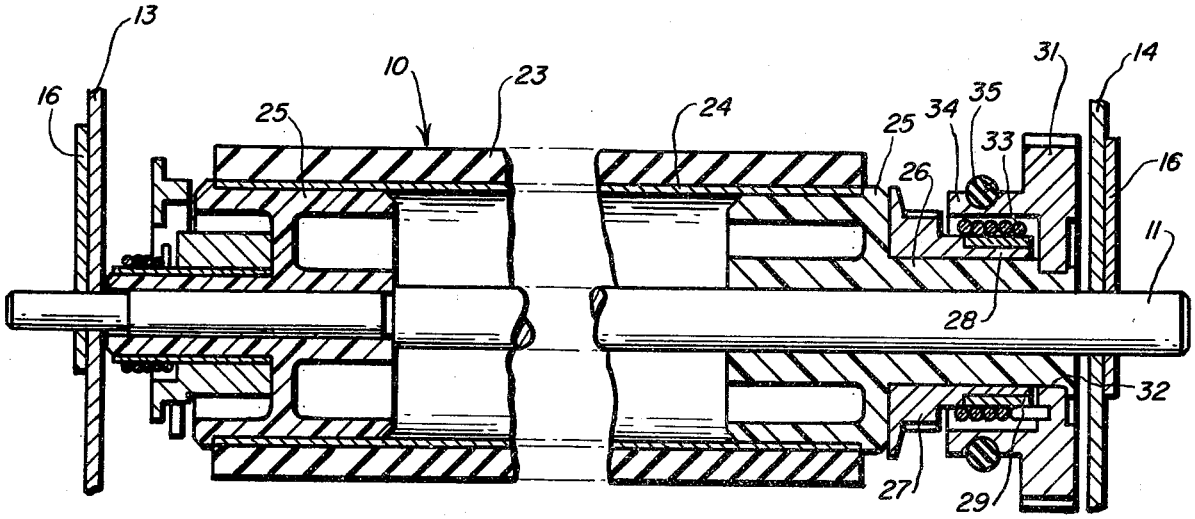

FIG. 1 is a perspective view of the power roll mounting and adjusting structure; and FIG. 2 is a sectional view showing the power construction.

DESCRIPTION OF THE INVENTION

Referring now to the drawing wherein like reference numerals designate like or corresponding parts throughout the several views, there is shown in FIG. 1 a power roll assembly generally designated by reference numeral 10 rotatably supported on a stationary power roll support shaft 11 which is adjustably secured in and relative to an opening 12 in a left side frame and in a similar opening (not shown) in a right side frame 14 by means of toothed eccentrics 15 rotatably adjustably secured as by bolts 15' to adjusting plates 16 only one of which is shown in FIG. 1.

Each adjusting plate 16 is provided with adjusting slots 17, 18 on either side of the toothed eccentric 15. The ends of the center shaft 11 extend through slots 18 of the adjusting plates 16 whereby on turning the eccentrics 15 the ends of the shaft 11 will be wedged between the end of the slots 18 and the eccentrics 15. A securing bolt 19 extends through each adjusting slot 17 to secure each adjusting plate 16 to the side frames 13 and 14 after being properly positioned.

With reference to FIG. 2, the power roll 10 comprises an outer rubber cover sleeve 23 supported on an inner core sleeve 24. Plastic bearings 25 which are supported on the center shaft 11 which extends therethrough, are press fitted into the ends of the core sleeves 24. The bearing 25 in the right end as viewed in FIG. 2 has an outwardly extending hub 26 which rotatably supports a toothed carriage return drive pulley 27 which itself has a rightward extending hub 28 around which is secured a metal sleeve 29. A power roll pulley 31 is keyed as at 32 to the end of the bearing hub 26 thereby to drive the power roll assembly 10 through bearing 25. A torque limiter spring 33 is tightly wrapped about the metal sleeve 29 and has one end secured to the power roll pulley 31 whereby the carriage return pulley 27 is normally frictionally driven. On initiation of a carriage return, the spring 33 will slip whereby the load of the carriage is assumed smoothly. The power roll pulley 31 is further provided with a hub 34 extending inwardly over the torque limiter spring 33 which supports an O-ring 35 which serves to drive a carriage return roll cam to engage a carriage return clutch thereby to couple drive from the carriage return pulley 27 as described in parent application of Madison, Ser. No. 333,389, filed Feb. 16, 1973.

The rotation of drive pulley 31 as by a toothed belt 36 will rotate the bearing 25 and connected power roll assembly 10 about the support shaft 11. As is clearly evident, the power roll assembly 10 can be easily removed by loosening the adjusting plates 16 and turning the eccentric 15 to release the shaft 11 for withdrawal from the bearings 25 and reassembled and adjusted in reverse fashion. By having the bearings 25 as part of the power roll assembly 10, it may be ground concentrically relative to the bearings 25 before assembly into a machine as distinguished from having to grinding it concentric to a shaft to be supported in bearings mounted in machine side frames as in the prior art.

The invention claimed is:

1. In a typewriter having side frames
- a power roll comprising a cylindrical sleeve,
- bearing means pressed into the ends of said sleeve,
- a shaft for rotatably supporting said bearing means extending through openings in said side frames,
- and means for non-rotatably securing the ends of said shaft relative to said side frames,
- one of said bearing means including
  - a drive pulley constituting a part of a motor driven speed reducing power train for continuously rotating said power roll,
- wherein said means for securing the ends of said shaft relative to said side frames include means associated therewith to permit individual adjustment of said shaft ends relative to said frames.

2. In a typewriter as recited in claim 1 wherein said means for adjustably securing the ends of said shaft to said side frames, comprising plates adjustably secured to said side frames, each of said plates having elongated openings to receive a shaft end and to permit individual adjustment relative to said frames and shaft wedging means adjustably pivotally secured to said plates, each of said wedging means having an eccentric periphery bearing against a shaft end and wedging the shaft end against a wall of the opening in a plate.

3. In a typewriter as recited in claim 2, said eccentric periphery of said shaft wedging means being formed with teeth to grip the wedged shaft.

* * * * *